United States Patent [19]

Koehler et al.

[11] Patent Number: 5,072,606

[45] Date of Patent: Dec. 17, 1991

[54] PEENING SHOT CURVING

[75] Inventors: Winfried Koehler, Hagnau; Klaus-Peter Hornauer, Aachen; Reiner Kopp, Aachen; Klaus Baldner, Aachen; Frank Wuestefeld, Aachen, all of Fed. Rep. of Germany

[73] Assignee: Dornier GmbH, Friedrichshafen, Fed. Rep. of Germany

[21] Appl. No.: 450,271

[22] Filed: Dec. 13, 1989

[30] Foreign Application Priority Data

Dec. 14, 1988 [DE] Fed. Rep. of Germany ..... 3842064

[51] Int. Cl.[5] ..... B21J 5/00; C21D 7/06

[52] U.S. Cl. ..... 72/53; 29/90.7; 51/319

[58] Field of Search ..... 29/90.7; 72/53, 40; 51/319

[56] References Cited

U.S. PATENT DOCUMENTS

| | | | |
|---|---|---|---|
| 3,668,912 | 6/1972 | Baughman et al. | 72/53 |
| 3,705,511 | 12/1972 | Brandel et al. | 72/53 |
| 4,329,862 | 5/1982 | Harburn et al. | 72/53 |
| 4,694,672 | 9/1987 | Baughman | 72/53 |

FOREIGN PATENT DOCUMENTS

| | | | |
|---|---|---|---|
| 2118085 | 10/1983 | United Kingdom | 72/53 |

OTHER PUBLICATIONS

John Vaccari, "Peen Forming Enters the Computer Age", 6/1985, pp. 91-94.

*Primary Examiner*—David Jones
*Attorney, Agent, or Firm*—R. H. Siegemund

[57] ABSTRACT

A method of shaping planar parts which have an elastic and plastic range for making components which are curved two dimensionally around two axes under utilization of a high pressure peening shot beam comprises the steps of tension positioning the part to obtain through elastic deformation to obtain the desired contour; peening the surface of the part to be deformed by running a beam of shot along track lines which are essentially lines of equal strain in the parts to be made; controlling the peening shot beam energy such that more central parts receive shot at a higher energy than more peripheral parts of said part; repeating the aforementioned steps on the other side of the part; and separately peening shot treating at least some of thicker edge parts, so as to obtain plastic deformation.

5 Claims, 2 Drawing Sheets

Fig. 2
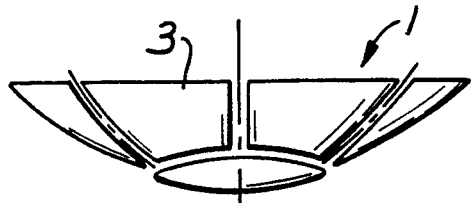
Fig. 1
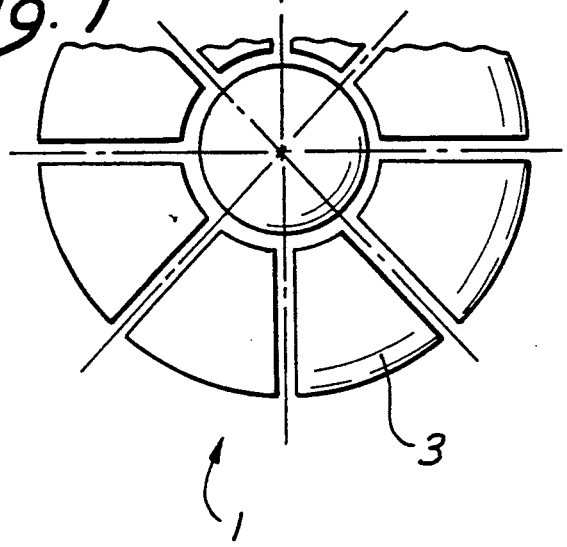
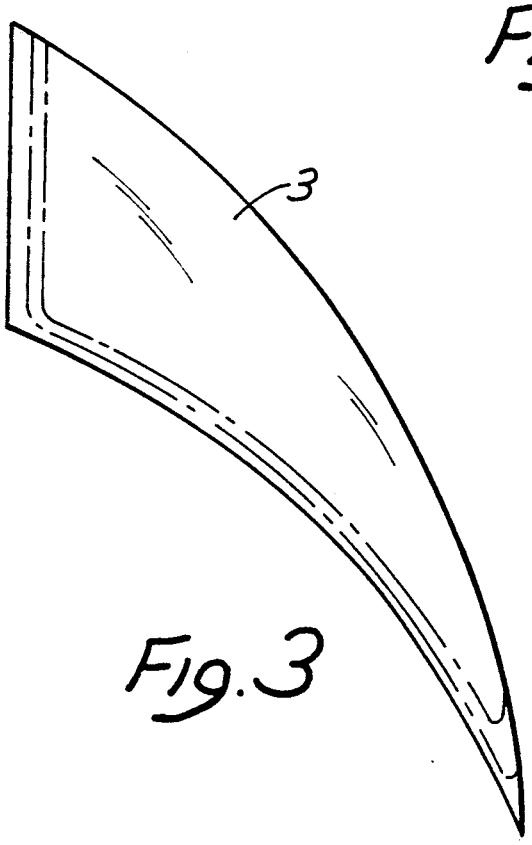
Fig. 3
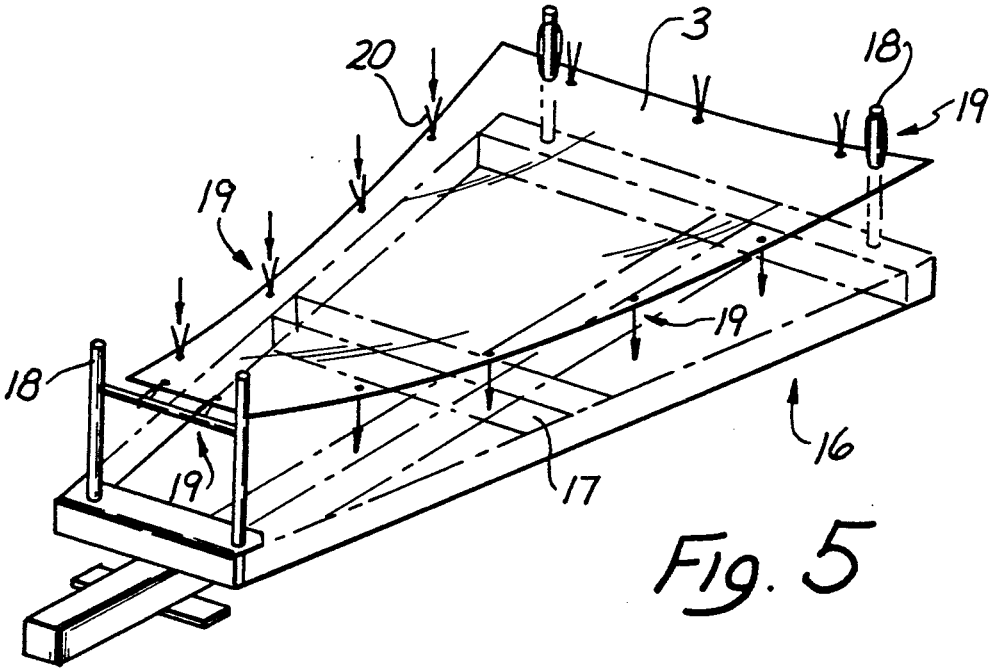
Fig. 5

PEENING SHOT CURVING

BACKGROUND OF THE INVENTION

The present invention relates to the forming and shaping of planar, plate shaped components and structure parts, into a curved configuration which can be defined as curvature about 2 different axes and more particularly the invention relates to a method of shaping such objects made of an elastic material which is under certain conditions plastic whereby the shaping is obtained through the deforming impact of ball shaped elements (peening shot) impinging upon the part at a high pressure up to 10 bar. For obtaining the desired shaping and still more particularly the invention relates to components which may have various thicknesses possibly with thickness steps somewhere along the extension.

It is known for quite some time to shape elastic and plastically behaving material and components by curving them around an axis in that e.g. steel balls (peening soft) are accelerated and caused to impinge upon the surface. On impact they produce locally strain and owing to exerted pressure that local tension results in physical extension of the surface layer through local plastic flow. Underneath the surface layer there are strata which owing to the extension produced above will exhibit certain strain will also plastically flow and eliminate elastic tension. The shaping procedure is practiced e.g. in the aerospace industry for making particularly shaped airplane parts. For example, panels, skin parts for the cells in an air plane; that means the coverage of the fuselage and/or the wing are shaped in this manner basically with shaping to obtain by curving the part around a particular axis.

U.S. Pat. No. 4,329,862 e.g. suggests such a method and proposes particularly acceleration of the little balls through impeller wheels or the like. These centrifugal wheels are arranged in a direction transversely to the relative motion between so the parts to be deformed. These parts (blanks) are somehow clamped to or received on a particular table or the like. These particular arrangements do not permit or only in a very rudimentary and incomplete fashioh shaping of planar parts around two different axes. Other state of the art references are e.g. U.S. Pat. Nos. 3,668,912 and 4,426,806 and art in similar subclasses as well as the art cited in these patents.

DESCRIPTION OF THE INVENTION

It is an object of the present invention to provide a new and improved shaping process through peening shot beams, and affecting planar parts to obtain a curved contour with curvatures obtaining in two different axes and, possibly the blank parts exhibit variation in thicknesses, even in a steplike fashion.

In accordance with the preferred embodiment of the present invention it is suggested to proceed for purposes of obtaining such curving as follows. The elastic part is tensioned into a concave position. The thusly positioned and tensioned part is subjected to a beam of peening shots whereby as a part of this treatment, the peening shot beam is guided along a track, which as far as the part to be deformed is concerned, will follow lines of similar, or at least almost similar, strain. The shot beam energy is reduced from a maximum when affecting a central part, towards outer contours or peripheral contours of the part being deformed. Subsequently the part is additionally subjected to a similar peening shot treatment from the other (usually the convex) side while edge portions are still separately treated as desired in accordance with particular requirements. The energy distribution is selected to change the ratio of longitudinal curvature to transverse curvature with a coverage degree between 10% and most of the entire surface of the part being treated. The energy gradient itself should preferably also decline from inner parts to edged portions.

The inventive method, therefore, begins in fact with the deformation of a planar part in a two axes type configuration as far as curvature is used, and uses by and in itself the known peening shot deformation method. The beam and its intensity in energy is preferably computer controlled under matching of direction and strength of peening shot impacting being controlled in dependence upon the dimensions of the part, particularly the lateral dimensions and the thickness possibly under consideration of variations of wall thickness and changes over the extension of the part, and with emphasis on parts which obtain similar extension as a result of the method.

A particular advantage of the invention is to be seen in that the thickness changes such as steps can be provided for in the part to be deformed prior to the application of the curving and deforming method the requisite thickness dimensions are obtained through suitable milling. Another advantage is to be seen in that parts as far as the blanks are concerned, are already hardened which means that subsequently no thermal treatement is necessary. Avoiding any heat application is an advantage since texture distortions in the material and, therefor, contour distortions are thus avoided. Also it was found that on practicing the invention the number of steps is reduced while reproducibility owing to accurate control of the peening shot intensity ensures that there is uniformity in the parts being made, which is of course a highly desirable feature. Owing to the method as suggested the working of the method is self adapting to changes on one hand in the thickness of the material and in the changes in material properties.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings whereby particularly an example is followed through step by step having to do with segmentized sheet metal parts.

FIG. 1 is a somewhat schematic top view of a spherical calotte shaped bottom part to be made out of the plural segments i.e. that botom is composed of a plurality of individual segments each of which has been deformed by the method of the invention a preferred embodiment in at best mode configuration;

FIG. 2 is a side view of the this composite part shown in FIG. 1;

FIG. 3 is a side and perspective view of an element or segment (FIG. 1,2) that has been made in accordance with the preferred embodiment of the present invention;

FIG. 5 illustrates a clamping frame and support for fixing and elastically biasing the part as it is being made.

Proceeding now to the detailed description of the drawings, FIGS. 1 and 2 show a particular component 1 which ultimately is a spherically calotte shaped bottom part of a container or the like. That part 1 is composed of plural individual segments 3 which when projected into a plane and which as far as the original blank 4 from which they have been made is concerned is a truncated pie or sector element. Since part 3 is to be a part of the spherical surface, a curving or the obtaining of curvatures in two axes is therefore required. FIG. 3 generally permits the conclusion that in fact there are involved two axes of curving. Originally of course such a segment 3 is planar and along its outer contour it has a thicker rim or ridge whereby outer ridge 5 is e.g. 4.5 mm thick, bounding an inner ridge or rim portion 6 of about 3.5 mm thickness, while the remainder of the panel is about 2.6 mm thick. The thicker edge parts are of course provided for accommodating the assembly of plural panels or segments into the overall component 1. The thickness differences have resulted from mechanical milling of an originally uniformly thick panel part, and this milling is carried out on the plane part prior to the curving.

Figure 4:
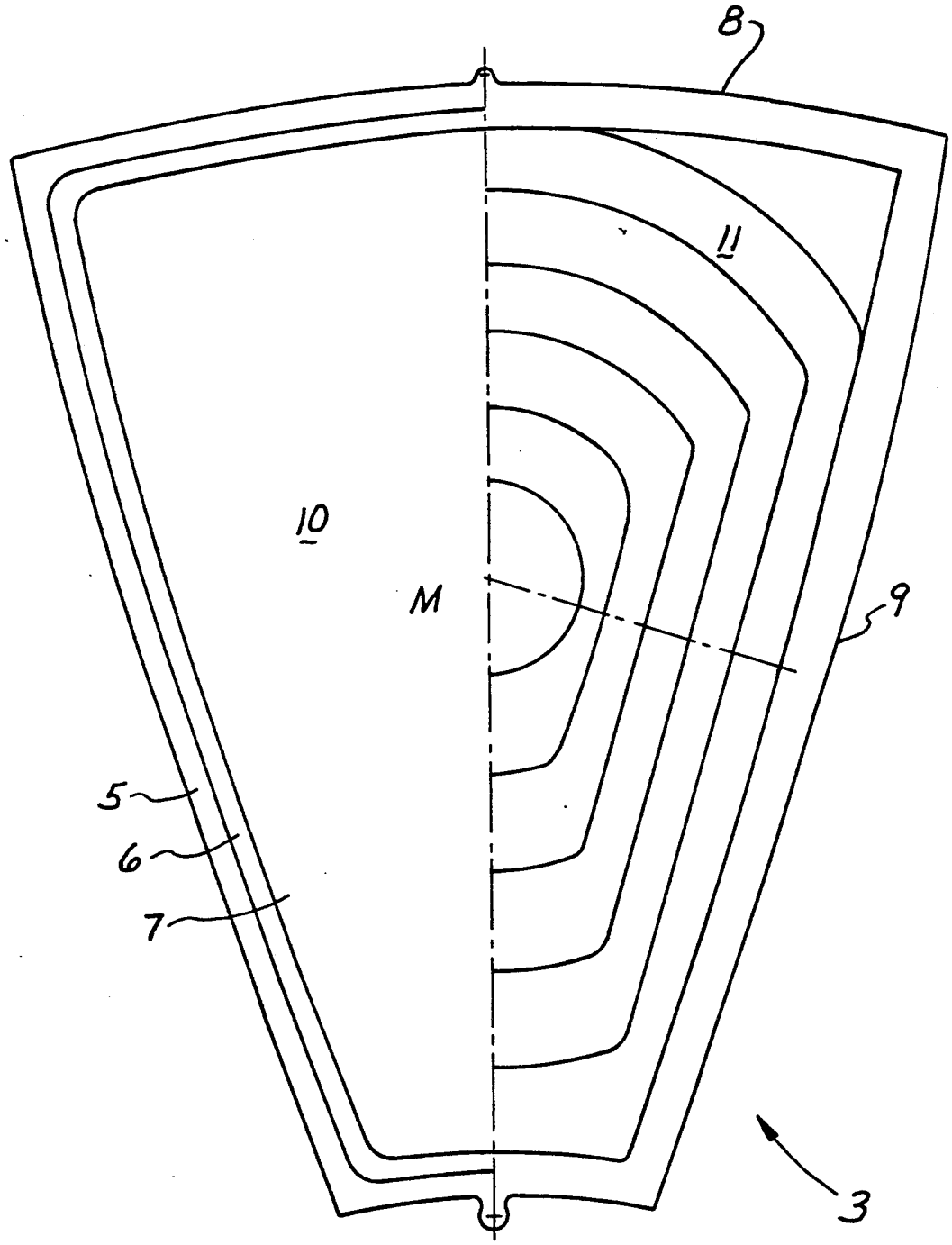
FIG. 4 is a top elevation of the particular part shown in FIG. 3.

The originally plane segment 3 is deformed thereafter through peening shot to impart a two axes curvature configuration upon it. This is generally obtained by placing the part 3 in a manner that will be described more fully below and impacting it by means of peening shot beams covering the entire surface of the panel 3 from both sides and through utilization and possibly variation of the peening shot beam parameter. In accordance with preplanned treatment strategy one obtains a gradual change in contour. Hereby one will usually run beam tracks in a polygonlike pattern corresponding to the overall geometry of the part 3 which is, as state, a truncated pie shaped segment.

Part 3 has in longitudinal direction an upper and a lower contour surface 8 and 8' respectively sides 9 whereby the center and middle part of the concave panel 10 itself and to be covered is designated by the letter M. Peening shot beam producing device is positioned above the side 10 facing that surface 10 from what will become the concave side of the part being made. The right hand portion of FIG. 4 shows these tracks 11 which the peening shot beam follows. These are of course hypothetical tracks and result from computer control of the beam producing device. These lines, owing to the particular contour, follow broadly speaking the rule that they are at least approximately equitensional or equistrain lines. These lines of course depend on the overall geometry of the part that is being deformed.

In addition of course one has to consider where the largest strain is supposed to occur which in this instance is the middle part around the center M. This as well as the outer contour of the part which will undergo minimal strain determines the pattern of the tracks 11.

In order to work in an appropriate and desired fashion the original planar part is tensioned onto a frame shown in FIG. 5. The frame includes a base 16 which includes a frame 17 and carries along its periphery support posts 18. The part 3 is originally a planar part, in this case a segment as described, and through suspensions on the rods or posts 18 and further under utilization of clamping devices 20, the part 3 is elastically curved around two axes and tensioned in that position to assume within that tool holder the contour desired to be maintained. Practicing the peening shot method means the providing of a plastic deformation to eliminate elastic tension and stress so that the curved contour is retained following removal from the tool.

Generally speaking, the device of FIG. 5 will hold the part to be made initially in the concave configuration, also as illustrated in FIG. 5 and thereafter the shot peening is carried from the top that means the shot impinges upon the concave side, using accelerated peening shot made of steel balls. Thereafter the part 3 is turned around and treated from the convex side. However it was found that one can proceed differently in treating first that side which will become permanently convex, turned around and finished by deforming now from the concave side.

The concave and convex contours are so to speak gradually fixed in that the plastic deformation obtained by the peening shot follows the contour lines 11 as shown in FIG. 4. The kinetic energy of the peening shot as applied will vary whereby the peening intensity declines from the inner to the outer portions i.e. from the region around the center M towards the periphery 8 and 9. Owing to the particular energy distribution of the peening shot one can also change the ratio of longitudinal curving to transverse curving. The degree of coverage varies between 10% and most of the entire surface 10 of this part. The thickness steps as resulting from the various thickness zones 5,6,7 will be treated in accordance with the matched parameter and parameter selection as far as the shot energy is concerned.

The invention is not limited to the embodiments described above but all changes and modifications thereof, not constituting departures from the spirit and scope of the invention, are intended to be included.

We claim:

1. Method of shaping planar parts which have an elastic and plastic range for making components which are curved two dimensionally around two axes and in the same direction to have a concave and a convex side, under utilization of a high pressure beam of peening shot comprsing the steps of;

tensioning and positioning a part to obtain initially and through deformation, the desired contour;

shot peening a surface of that part from the concave side with peening shot by running at least one shot beam along track lines which are essentially lines of equal strain in the part to be made to begin obtaining plastic deformation on the part;

controlling the peening shot beam energy such that more central parts receive shot at a higher kinetic energy than more peripheral parts of said part;

shot peening the convex side of the part so that a plastic deformation of the part is obtained; and the part having thick edge parts, separately peening shot treating at least some of the thick edge parts.

2. Method as in claim 1, wherein the energy gradient of the peening shot applied decreases from central to more peripheral portions of the part being treated.

3. Method of shaping planar parts which have an elastic and plastic range for making components which are curved two dimensionally around two axes under utilization of a high pressure beam of peening shot comprising the steps of:

tensioning and positioning such a part to obtain preliminary through elastic deformation, the desired contour; the contour to be maintained subsequently by shot peening, the part thus obtaining a convex and a concave side;

shot peening first a surface of the part from the concave side of the part, with a beam of peening shot being run along track lines which are essentially lines of equal strain in the part to be made;

second shot peening a surface of the part from the convex side subsequent or prior to the first shot peening step;

controlling the peening shot beam energy such that more central parts of the concave side receive shot at a higher kinetic energy than more peripheral parts of said part; and the part having thick edge parts, separately shot peening at least some of the edge parts.

4. Method as in claim 3, wherein the energy gradient of the peening shot applied decreases from central to more peripheral portions of the part being treated.

5. Method of shaping planar parts which have an elastic and plastic range for making components which are curved two dimensionally around two axes under utilization of a high pressure beam of peening shot comprising the steps of tension positioning the parts to obtain initially and through elastic deformation the desired contour resulting in a convex side and a concave side of the part, the part further having relatively thick edge portions:

treating first the surface of that part from its convex side with a beam of peening shot while running the beam along track lines which are essentially lines of equal strain in the parts to be made;

controlling the peening shot beam energy such that more central parts receive shot at a higher kinetic energy than more peripheral portions of said part;

repeating the aforementioned steps on the concave side of the part; and separately peening shot treating at least some of the thick edge portions.

* * * * *